United States Patent [19]

Carter et al.

[11] Patent Number: 4,717,009

[45] Date of Patent: Jan. 5, 1988

[54] CONVEYOR ARRANGEMENT FOR ROD-LIKE ARTICLES

[75] Inventors: David C. M. Carter, Coventry; Ian Dunckley, High Wycombe; Kerry Hierons, High Wycombe; Robert J. C. S. Mitchell, High Wycombe, all of England

[73] Assignee: Molins Machine Co. Inc., Bucks, United Kingdom

[21] Appl. No.: 769,973

[22] Filed: Aug. 27, 1985

[30] Foreign Application Priority Data

Aug. 30, 1984 [GB] United Kingdom ..... 8421940

[51] Int. Cl.[4] ..... B65G 1/00

[52] U.S. Cl. ..... 198/347; 198/454

[58] Field of Search ..... 198/347, 454; 53/148, 53/151; 131/282, 283

[56] References Cited

U.S. PATENT DOCUMENTS

| | | | |
|---|---|---|---|
| 3,305,128 | 2/1967 | Dearsley | 198/347 |
| 3,480,129 | 11/1969 | Tatibana | 198/454 |
| 3,985,252 | 10/1976 | Hinchcliffe et al. | 198/454 X |
| 4,364,462 | 12/1982 | Tolasch et al. | 198/347 |
| 4,368,742 | 1/1983 | Wahle et al. | 198/347 X |
| 4,420,073 | 12/1983 | Hausler et al. | 198/347 |

FOREIGN PATENT DOCUMENTS

| | | | |
|---|---|---|---|
| 2804658 | 8/1978 | Fed. Rep. of Germany | 198/347 |

*Primary Examiner*—Joseph E. Valenza
*Assistant Examiner*—Jonathan D. Holmes
*Attorney, Agent, or Firm*—Antonelli, Terry & Wands

[57] ABSTRACT

A variable capacity region for rod-like articles such as cigarettes, particularly a buffer reservoir (48) arranged at the juction between a conveyor (10) and the entrance (28) to a consuming machine, includes a continuously-driven inclined conveyor (36) to promote recirculation of articles within the reservoir and discourage extended periods of occupation by individual articles.

19 Claims, 2 Drawing Figures

CONVEYOR ARRANGEMENT FOR ROD-LIKE ARTICLES

This invention relates to apparatus for conveying rod-like articles, particularly articles of the tobacco industry such as cigarettes or filter rods.

Various arrangements are known for conveying rod-like articles between machines or parts of machines operable at different speeds. Such arrangements may include a variable capacity buffer reservoir which accommodates differences between the rate of supply and rate of consumption of articles. Examples of variable capacity buffer reservoirs for rod-like articles are Molins OSCAR and Molins MOLAR. Variable capacity reservoirs for rod-like articles are shown in U.S. Pat. Nos. 3,703,971, 3,759,408, 3,921,790 and 4,339,025.

According to one aspect of the present invention a conveyor arrangement for rod-like articles comprises conveyor means for conveying rod-like articles in a direction transverse to their lengths to a variable capacity region having an exit for said articles, said region being arranged so that articles may move in said region in a direction other than towards said exit, further conveyor means for conveying articles in said region, and drive means connected to said further conveyor means so that articles are urged towards said exit whenever said drive means is operated. Said region may comprise a reservoir for rod-like articles. The drive means may be unidirectional.

Preferably said conveyor means is arranged to convey a multi-layer stream of articles in stack formation to said region. Preferably the exit is arranged to allow a multi-layer stream to leave the region along a delivery path. The conveyor means and said delivery path may extend in different directions. For example, the conveyor means may convey articles in a generally horizontal direction and said path may extend substantially vertically. Hence, the region may comprise a junction zone associated with a change in direction of articles.

The further conveyor means may extend in a direction which differs from that of the conveyor means; it may extend in a direction generally towards said exit; it may extend downwardly, e.g. at an angle in the range of 0–45 degrees to the vertical.

Preferably said region is arranged so that a boundary layer of articles received in said region may move towards or away from the exit as the number of articles in the region varies. In this case the driving means may be arranged to operate said further conveyor means to convey articles towards the exit at times, inter alia, when the boundary layer is moving away from the exit.

The driving means is preferably operable simultaneously with said conveyor means, so that the further conveyor means is operated whenever the conveyor means is feeding articles to the region. Alternatively the driving means could be operated only at times when it is required to deliver articles to or from the exit of the region.

Means may be provided within the region for confirming a leading or boundary surface of articles within the region. Such means may comprise a flexible membrane. Sensor means may be provided for detecting the state of fill of the region, e.g. by means of photodetectors or a pivoted sensor arm resting on articles within the region, and such sensor means may be operable to control the conveyor means or a delivery device connected to said exit (and possibly also the further conveyor means).

In a preferred arrangement the conveyor means and the further conveyor means each comprise endless band conveyors. The endless band conveyor of the further conveyor means preferably has an operative run which extends in a direction which is different to that of the conveyor means, and may extend towards or be inclined downwardly towards said exit. In this case, the conveyor means may extend substantially horizontally and the exit may be arranged above a substantially vertical path, the further conveyor means forming an inclined (or vertical boundary wall for said region generally opposite the point of entry of articles from the conveyor means.

The region may comprise a reservoir associated with a mass flow conveyor system for articles passing from one or more delivery devices (e.g. a cigarette making machine) to one or more article receiving devices (e.g. a cigarette packing machine). Preferably, and especially where said reservoir is arranged at or near a downstream end of the system (i.e. adjacent the receiving device or devices), the state of fill of the reservoir (as detected by sensor means) may be used to control other reservoirs or reservoir systems, generally having a larger capacity than said reservoir, associated with the conveyor system. A way in which this may be achieved is disclosed in our copending U.S. patent application Ser. No. 721,438, the disclosure of which is hereby incorporated herein in its entirety.

According to another aspect of the invention a conveyor arrangement for rod-like articles comprises means defining a first path for articles conveyed in a direction transverse to their lengths, means defining a second path for articles conveyed in a direction transverse to their lengths, said first and second paths extending in different directions, a junction zone arranged between said first and second paths and defining a third path for articles passing between said first and second paths, and conveyor means for conveying articles within said junction zone towards said second path in a direction which differs from that of said first, second, and third paths.

According to a further aspect of the invention a conveyor arrangement for rod-like articles moving in a direction transverse to their lengths includes a junction zone having a spaced inlet and outlet, a relatively direct path extending between said inlet and said outlet, a variable capacity region within said junction zone but not on said path, and means for continuously urging articles from said region onto said path.

According to a still further aspect of the invention a conveyor arrangement for rod-like articles in multi-layer stack formation, comprising means defining a variable capacity reservoir region, means for delivering articles to said region, means for delivering articles from said region, and means for moving articles within said region at least while articles are being delivered to and/or from said region, whereby replacement of articles within said region is promoted to discourage extended periods of occupation of said region by any individual article.

The invention will be further described, by way of example only, with reference to the accompanying diagrammatic drawings, in which.

Figure 1:
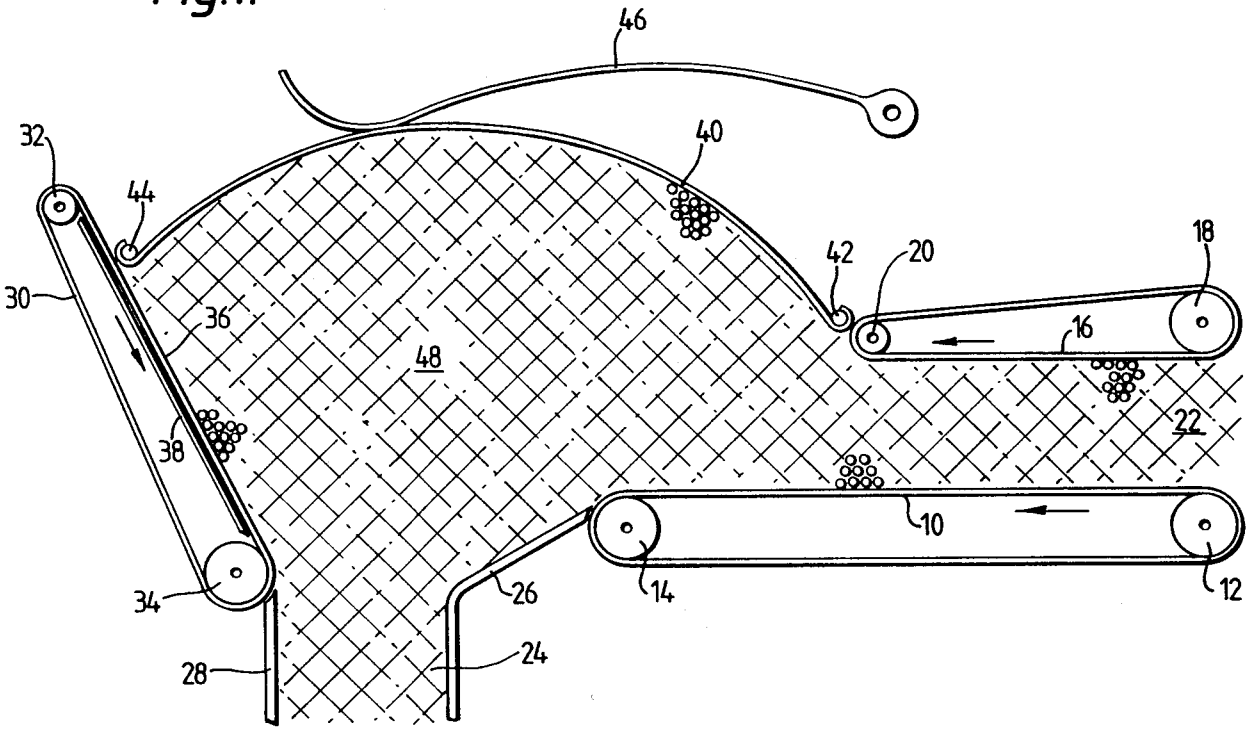
FIG. 1 is a side view of a conveyor arrangement for rod-like articles.

Referring to FIG. 1, a lower endless band conveyor 10 passing around pulleys 12, 14 and an upper endless band conveyor 16 passing around pulleys 18, 20 are arranged to receive a stream 22 of filter cigarettes from upstream conveyors (not shown). The stream 22 is of multi-layer stack formation and is typically 80–100 mm height. The stream 22 may be received directly or indirectly from a filter cigarette making or assembling machine. The conveyor 10 and/or the conveyor 16 may be provided with spaced flights or other protrusions to aid conveyance of the stream 22.

The stream 22 is conveyed by the conveyors 10, 16 towards a downwardly-extending chute or downdrop 24, defined between a substantially vertical part of an angled guide 26, extending from the region of the pulley 14, and a substantially vertical guide 28.

An endless band conveyor 30 passing around pulleys 32 and 34, the latter of which is adjacent the upper end of guide 28, has an inclined run 36 which is generally opposite the path of the stream 22 and extends upwards from the region of the downdrop 24. An inclined backing plate 38 is provided to support the run 36 of conveyor 30. It will be appreciated that the conveyor 16, and particularly the conveyor 10, may also be provided with appropriate backing or support plates for their operative runs.

A membrane 40, of TISS-metal or other suitable flexible material, extends between a support post 42 adjacent the pulley 20 and a support post 44 adjacent the pulley 32. A pivoted sensor arm 46 rests on the membrane 40. The region below the membrane 40 and adjacent the conveyor 30 consititutes a variable capacity reservoir 48 for cigarettes, arranged between the conveyors 10, 16 and the downdrop 24. In FIG. 1 the reservoir 48 is at or near its full condition.

Figure 2:
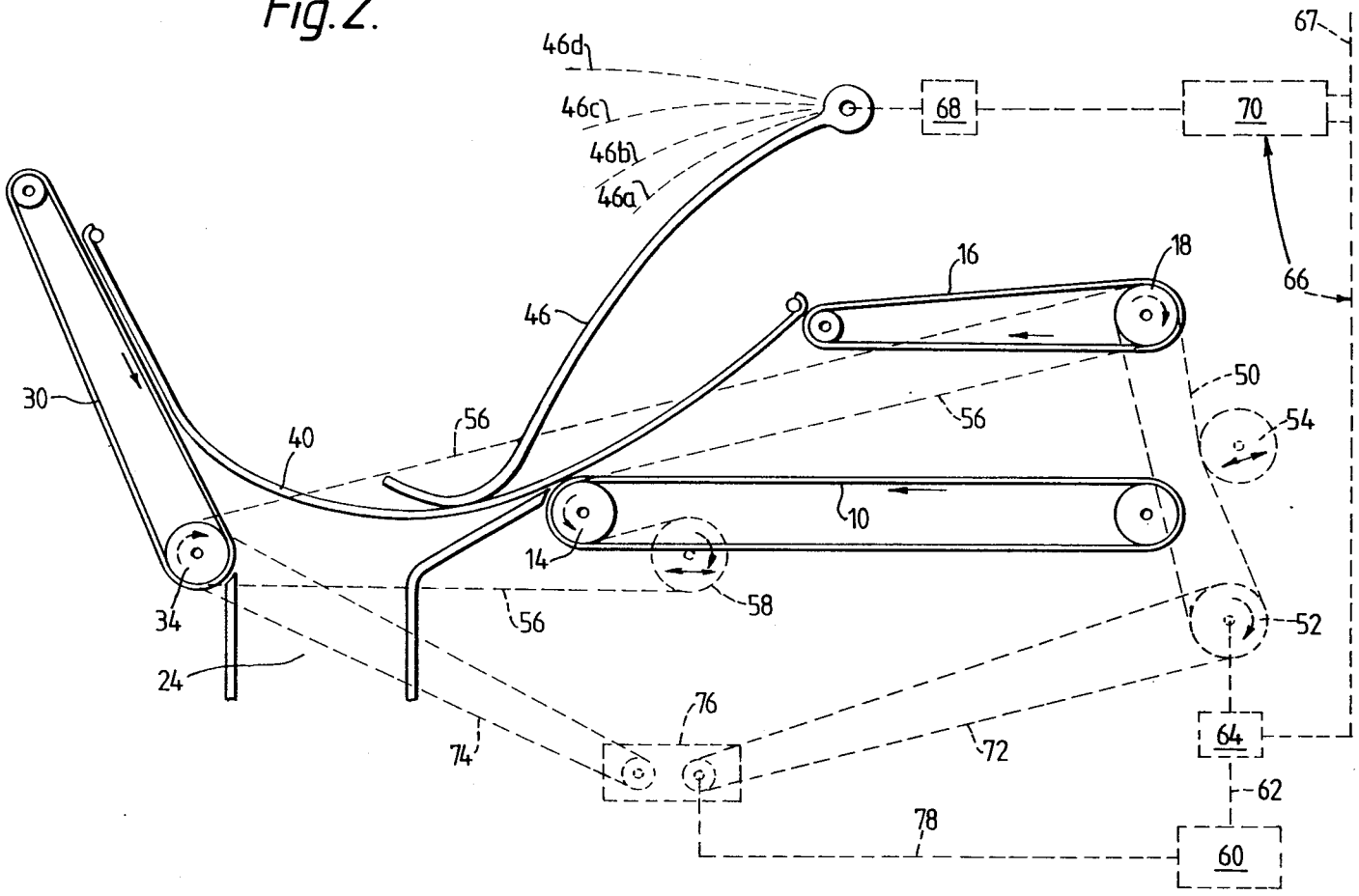
FIG. 2 is a similar side view of the conveyor arrangement of FIG. 1, with parts in different operative positions, and showing drive connections to the arrangement.

Referring to FIG. 2, which shows the conveyor arrangement without cigarettes, the pulley 18, and hence the conveyor 16, is driven by a timing belt 50 passing around the pulley and also around a driven pulley 52. A tensioning pulley 54 is provided for the belt 50. A further timing belt 56 passes around the pulley 18 and also around the pulleys 14 and 34 in such manner that the bands 10 and 30 are driven in the desired directions. The belt 56 also passes around a tensioning pulley 58.

The pulley 52 is driven from a prime mover 60 by a transmission 62 which includes a variable speed device 64 (e.g. a PIV gearbox). The device 64 is connected by a circuit 66 to a rotary regulator 68 associated with the sensor arm 46. The circuit 66 includes a part 70 for responding to signals received from the regulator 68 and for sending appropriate signals to alter the speed of the device 64.

The belt 56 may be replaced by a shorter belt passing around the pulley 14 but not the pulley 34. Alternatively the belt 56 may pass around a pulley which is coaxial with the pulley 34 but not connected for rotation with it. In these cases drive to the pulley 34 may be derived from the pulley 52 by first and second timing belts 72, 74, respectively, which are connected by a variable speed device 76 (e.g. a PIV gearbox). If it is desired that the speed of the conveyor 30 should not be controlled in accordance with signals derived from the sensor arm 56 the belt 72 may be replaced by a transmission 78 (which could be a further timing belt) extending directly from the prime mover 60 (or from a separate prime mover).

The operation of the conveyor arrangement is such that the conveyors 10 and 16 are driven at the same speed, the pulleys 14 and 18 being of similar diameter, the speed being related to the speed of the conveyors of the stream 22 upstream of the conveyors 10, 16. The prime mover 60 and/or the device 64 could also drive the upstream conveyors, and/or be controlled in accordance with the upstream rate of feed of cigarettes (e.g. the rate of a filter cigarette assembling machine). The stream 22 conveyed by the conveyors 10, 16 passes into the reservoir region 48 and into the downdrop 24. The rate of removal cigarettes from the reservoir 48 depends on the rate of passage of articles through the downdrop 24. Where the downdrop 24 leads to a consuming machine (such as a cigarette packing machine) this rate is determined by the speed of operation of the consuming machine. The relative speeds of the stream 22 and the stream passing through the downdrop 24 determine the state of fill of the reservoir 48.

In one preferred mode of operation the state of fill of the reservoir 48 is controlled by the sensor arm 46 and associated circuitry in the following manner. When the reservoir 48 contains cigarettes such that the sensor arm 46 is in a position within the range between the positions indicated by the dotted lines **46*b* and 46*c* in FIG. 2, the reservoir is regarded as in a normal condition, and the regulator 68 and circuit 66 apply no correcting signals to the ratio device 64. The speed of the conveyors 10, 16 is in this case, therefore, determined by factors other than the position of the sensor arm 46. Such factors clearly include the predetermined median setting of the device 64 and the speed of the prime mover 60 (which may depend on the rate of supply of filter cigarettes from the filter cigarette assembling machine). If the reservoir 48 fills so that the arm 46 rises above the line 46*c* then the regulator 68 and circuit 66 are effective to apply a correction signal to the device 64 to reduce the speed of the driven pulley 52. Conversely if the number of articles in the reservoir 48 reduces, so that the arm 46 falls below the lever of the line 46*b* then the correction applied to the device 64 is such as to increase the speed of the pulley 52. If, in spite of a reduction in speed of the conveyors 10, 16 the arm 46 reaches a high position 46*d*, in which the reservoir 48 is full, the circuit 66 is operative to disconnect the drive at the device 64, so that the conveyors 10, 16 are stopped; this may also means stopping the upstream conveyors and/or the filter cigarette assembling machine. Similarly, if the arm 46 reaches a position 46*a*, in which the reservoir 48 is substantially empty, the consuming machine being fed by the downdrop 24 is stopped (e.g. by a signal passed on a line 67 from the circuit 66**).

Instead of having a range of positions for the arm 46, between the positions **46*b* and 46*c*, in which no correcting signal is applied to the device 64, the regulator 68 may be arranged to respond and apply an appropriate correction signal according to whether the arm 46 is above or below a single intermediate position, e.g. midway between the positions 46*b* and 46*c*. In either case the correction applied to the device 64 could be proportional to the amount of deviation of the arm 46 from its intermediate position or normal range or the correction applied could be fixed. For example, the circuit 66 and device 64 may be arranged to increase the speed of conveyors 10, 16 by 10% when the arm 46 is between positions 46a and 46b, and to decrease the speed by 10% when the arm is between the positions 46c and 46d**.

In another possible mode of operation, particularly for use when the conveyor arrangement forms part of a system which includes a buffer reservoir, the buffer reservoir comprising a reversible reservoir for rod-like articles in stack formation, such as Molins OSCAR, and/or a reservoir unit in which articles are received from the system in trays and returned to the system from trays, a signal indicative of the state of fill of the reservoir 48 is obtained from the circuit 55 (e.g. on the line 67) and is used to control the operation of the buffer reservoir. For example, when the sensor arm 46 reaches the position 46d articles may be diverted form the system into the buffer reservoir, and when the sensor arm reaches the position 46a articles may be diverted to the system from the buffer reservoir. Systems in which the present conveyor arrangement may be operated in this manner are disclosed in British patent specification No. 2142894 and in U.S. patent applications Ser. Nos. 628,304, 721,414 and 721,438, the disclosures of which are hereby incorporated herein in their entireties. In particular, the conveyor arrangement of the present invention may replace in structure and all aspects of its operation the reservoir 46 and analogous associated parts disclosed in application Ser. No. 721,438. More generally, and irrespective of its precise mode of operation, the present conveyor arrangement may be employed at or adjacent a downdrop leading to a packing machine, in general and in any of the systems disclosed in said applications.

The pulley 34 is of similar diameter to the pulleys 14 and 18. Hence the conveyor 30 is driven by the belt 56 at a linear speed which in the same as that of the conveyors 10, 16. The run 36 of the conveyor 30 forms an inclined wall of the reservoir 48 and, together with the membrane 40, defines a reservoir of usefully large capacity. The total capacity of the reservoir 48 (as defined by the difference in number of cigarettes contained between the minimum and maximum operating positions of the membrane 40, i.e. between the position 46a and 46d of the sensor arm) is 1000 cigarettes. The fact that the run 36 of the conveyor 30 is inclined provides some additional capacity. The run 36 is inclined at 27° to the vertical: the preferred range of inclinations is 0°–45° to the vertical.

The surface of the conveyor 30 is relatively smooth but the movement of the conveyor is sufficient to prevent cigarettes remaining stagnant in a region adjacent the conveyor. It will be appreciated that in normal operation the speeds of delivery and consumption of the stream 22 are reasonably well matched, so that the membrane 40 and arm 46 remain in or adjacent to their normal or median positions. Consequently there is a relatively direct path for cigarettes passing from between the bands 10, 16 to the downdrop 24, the upper surface of this path curving generally downwards from the region of the pulley 20 to the region of the guide 28. There is, therefore, a certain region of the reservoir 48, lying above this path and relatively closer to the conveyor 30 than to the pulley 20, in which the cigarettes may have a tendency to become static in the absence of operation of the conveyor 30. If the conveyor 30 is driven, however, the gentle action of the run 36 urging the adjacent cigarettes towards the downdrop 24 causes the cigarettes in this region, which might otherwise remain in the reservoir 48 for some time, to be progressively and continuously intermixed with those coming more directly from the stream 22. The result is that no cigarettes remain in the reservoir 48 for a long time while the conveyor arrangement is running. In effect, therefore, the reservoir 48 may be regarded as substantially equivalent to a first-in first-out buffer device by ensuring that cigarettes do not remain in the reservoir indefinitely and degrade.

While it is presently preferred that the conveyor 30 should be run at a speed which is equal to that of the conveyors 10, 16, the alternative drive arrangements 72-76 or 74, 78 allow operation of the conveyor 30 at any desired speed. The conveyor 30 could be provided with a relatively rough surface, or even with flights to aid conveyance of the cigarettes.

Instead of providing an endless band conveyor 30 a vibratory conveyor surface could be provided for the corresponding boundary of the reservoir 48.

The membrane 40 and sensor 46 could be replaced with a membrane which directly operates a regulator. For example, the membrane 54 disclosed in British patent specification no. 2124174, or U.S. patent application Ser. No. 517,408 to which reference is directed for further details, could be used.

We claim:

1. A conveyor arrangement for rod-like articles, comprising conveyor means for conveying rod-like articles in a direction transverse to their lengths, means defining a variable capacity region for receiving articles from said conveyor means and having an exit for said articles, said region being arranged so that articles may move in said region in a direction other than towards said exit, with the result that a boundary layer of articles received in said region may move towards or away from the exit as the number of articles in the region varies, further conveyor means including at least one endless band forming part of a boundary wall of the region and extending in a direction transverse to said conveyor means and the adjacent portion of said boundary layer for conveying articles in said region, movable means for confining said boundary layer of articles in said region, and drive means connected to said further conveyor means for driving said further conveyor means so that articles are urged towards said exit whenever said drive means is operated, said drive means being arranged to operate simultaneously with drive means for said conveyor means, said conveyor means and said further conveyor means being arranged to convey articles in said variable capacity region in directions generally towards each other and towards said exit, whereby replacement of articles within said region is promoted to discourage extended periods of occupation of said region by any individual article and to encourage movement of articles from said region.

2. A conveyor arrangement as claimed in claim 1, wherein said drive means is unidirectional.

3. A conveyor arrangement as claimed in claim 1, wherein the conveyor means includes means arranged to convey a multi-layer stream of articles in stack formation to said region.

4. A conveyor arrangement as claimed in claim 3, wherein the exit is defined by means arranged to allow a multi-layer stream to leave the region along a delivery path.

5. A conveyor arrangement as claimed in claim 4, wherein the conveyor means and the delivery path extend in different directions.

6. A conveyor arrangement as claimed in claim 5, wherein the conveyor means extends in a generally horizontal direction and the delivery path extends in a generally vertical direction.

7. A conveyor arrangement as claimed in claim 1, wherein the further conveyor means extends in a direction which differs from that of the conveyor means.

8. A conveyor arrangement as claimed in claim 1, wherein the further conveyor means extends in a direction generally towards said exit.

9. A conveyor arrangement as claimed in claim 8, wherein the further conveyor means extends downwardly.

10. A conveyor arrangement as claimed in claim 9, wherein the further conveyor means extends at an angle in the range 0–45 degrees to the vertical.

11. A conveyor arrangement as claimed in claim 1, wherein the further conveyor means and the conveyor means are arranged on substantially opposite sides of said region.

12. A conveyor arrangement as claimed in claim 1, including sensor means responsive to the state of fill of the region and drive control means linked to the sensor means for controlling said drive means.

13. A conveyor arrangement as claimed in claim 12, further including reservoir means associated with said conveyor means, said reservoir means having an associated drive, said drive control means being linked to said drive for control of said reservoir means.

14. A conveyor arrangement as claimed in claim 1, including means for operating said drive means substantially continuously whenever articles are passing to or from said region.

15. A conveyor arrangement for rod-like articles, comprising conveyor means for conveying rod-like articles in a direction transverse to their lengths, means defining a variable capacity region for receiving articles via an inlet from said conveyor means and having an exit for said articles so that said articles generally flow through said region, said region being confined except for said inlet and exit and being arranged so that articles entering said region through said inlet may move in said region in a direction other than towards said exit, further conveyor means extending in a direction transverse to said conveyor means for conveying articles in said region toward said exit, and drive means connected to said further conveyor means for driving said further conveyor means so that articles which move in said region in a direction other than toward said exit are urged eventually towards said exit whenever said drive means is operated, said conveyor means and said further conveyor means being arranged to convey articles in said variable capacity region in directions generally towards each other and towards said exit, whereby replacement of articles within said region is promoted to discourage extended periods of occupation of said region by any individual article and to encourage movement of articles from said region.

16. A conveyor arrangement for rod-like articles, comprising conveyor means for conveying rod-like articles in a direction transverse to their lengths, means defining a variable capacity region for receiving articles from said conveyor means and having an exit for said articles, said region being at least partially limited by a member which is movable in response to the pressure of the articles in said region to vary the capacity of said region and said region being arranged so that articles may move in said region in a direction other than towards said exit, further conveyor means extending in a direction transverse to said conveyor means for conveying articles in said region, said movable member being movable in response to an increase in the number of articles in the region in a direction which is opposite to the direction of conveyance of said further conveyor means at least in the vicinity of said further conveyor means, and drive means connected to said further conveyor means for driving said further conveyor means so that articles are urged generally towards said exit whenever said drive means is operated, whereby replacement of articles within said region is promoted to discourage extended periods of occupation of said region by any individual article and to encourage movement of articles from said region.

17. A conveyor arrangement as claimed in claim 16, wherein said movable member is a flexible membrane which moves in response to the pressure of articles within said region.

18. A conveyor arrangement as claimed in claim 16, wherein said movable member is positioned so as to be spaced from said exit with said further conveyor means being disposed between said movable member and said exit.

19. A conveyor arrangement for rod-like articles, comprising conveyor means for conveying rod-like articles in a direction transverse to their lengths, means defining a region for receiving articles form said conveyor means and having an exit for said articles, said region having a capacity which varies in direct response to the difference between the inflow of articles thereto and the outflow of articles therefrom, said region being limited by a member which is movable in response to the pressure of the articles in said region so that said region is confined except for said inlet and said outlet and said region being arranged so that articles may move in said region in a direction other than towards said exit, further conveyor means extending in a direction transverse to said conveyor means for conveying articles in said region generally towards said exit, said movable member being movable in response to an increase in the number of articles in the region in a direction which is opposite to the direction of conveyance of said further conveyor means at least in the vicinity of said further conveyor means, and drive means connected to said further conveyor means for driving said conveyor means so that articles are urged towards said exit whenever said drive means is operated, whereby replacement of articles within said region is promoted to discourage extended periods of occupation of said region by any individual article and to encourage movement of articles from said region.

* * * * *